US011267147B2

(12) United States Patent
Phoon et al.

(10) Patent No.: US 11,267,147 B2
(45) Date of Patent: Mar. 8, 2022

(54) BLADE SET ASSEMBLY AND HAIR CUTTING APPLIANCE

(71) Applicant: KONINKLIJKE PHILIPS N.V., Eindhoven (NL)

(72) Inventors: Kin Fatt Phoon, Drachten (NL); Auke Meint Jan Veninga, Harkstede (NL); Willem Maat, Rohel (NL); Roel Alexander Rethmeier, Drachten (NL); Siegfried Sablatschan, Ferlach (AT); Bernhard Schratter, Klagenfurt (AT)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/733,396

(22) PCT Filed: Jan. 10, 2019

(86) PCT No.: PCT/EP2019/050475
§ 371 (c)(1),
(2) Date: Jul. 20, 2020

(87) PCT Pub. No.: WO2019/145150
PCT Pub. Date: Aug. 1, 2019

(65) Prior Publication Data

US 2021/0094195 A1 Apr. 1, 2021

(30) Foreign Application Priority Data

Jan. 25, 2018 (EP) ..... 18153367

(51) Int. Cl.
*B26B 19/38* (2006.01)
*B26B 19/06* (2006.01)

(52) U.S. Cl.
CPC ..... *B26B 19/3846* (2013.01); *B26B 19/06* (2013.01); *B26B 19/3853* (2013.01)

(58) Field of Classification Search
None
See application file for complete search history.

(56) References Cited

U.S. PATENT DOCUMENTS 2,579,924 A 12/1951 Adolph
3,279,062 A * 10/1966 Andis ..... B26B 19/06 30/210

(Continued)

FOREIGN PATENT DOCUMENTS

EP 3 517 257 A1 * 7/2019
FR 2975623 11/2012

(Continued)

OTHER PUBLICATIONS

International Search Report and Written Opinion dated Apr. 9, 2019 for International Application No. PCT/EP2019/050475 Filed Jan. 10, 2019.

*Primary Examiner* — Hwei-Siu C Payer

(57) ABSTRACT

A blade set assembly for a hair cutting appliance includes a stationary blade and a movable blade. The movable and stationary blades are arranged one on top the other and movable relative to each other. A guide unit is formed between the movable blade and the stationary blade, where the blades engage each other. The guide unit includes longitudinally spaced, laterally extending guideways, each defined between a stationary blade guide surface and a movable blade guide surface that overlap each other. Rolling elements are arranged at the guideways between the guide surfaces. The guide surfaces have a height extension greater than a radius of the rolling elements such that the guide surfaces overlap in a vertical direction. The guide surfaces provide for coupling in a longitudinal direction between the blades such that the guide unit provides for a set longitudinal distance for any force applied in the longitudinal direction.

20 Claims, 9 Drawing Sheets

(56) References Cited

U.S. PATENT DOCUMENTS

| | | | | |
|---|---|---|---|---|
| 3,967,372 | A | 7/1976 | Beck | |
| 4,221,050 | A | 9/1980 | Walter | |
| 5,909,929 | A | 6/1999 | Chen | |
| 6,098,288 | A | 8/2000 | Miyagawa | |
| 8,453,333 | B2 * | 6/2013 | Long | B26B 19/06 30/210 |
| 10,919,165 | B2 * | 2/2021 | Hoexum | B26B 19/06 |
| 2011/0265331 | A1 | 11/2011 | Moseman | |
| 2012/0233865 | A1 | 9/2012 | Kammer | |
| 2014/0259689 | A1 | 9/2014 | Lau | |
| 2015/0209969 | A1 * | 7/2015 | Sablatschan | B26B 19/12 30/216 |
| 2015/0328785 | A1 | 11/2015 | Sablatschan | |
| 2017/0190062 | A1 | 7/2017 | Sablatschan | |
| 2021/0094195 | A1 * | 4/2021 | Phoon | B26B 19/06 |

FOREIGN PATENT DOCUMENTS

| | | |
|---|---|---|
| GB | 1091081 | 11/1967 |
| RU | 2103158 | 1/1998 |
| WO | 2000048795 | 8/2000 |
| WO | 2010/051929 | 5/2010 |
| WO | 2014/095101 | 6/2014 |
| WO | 2017/153482 | 9/2017 |

* cited by examiner

BLADE SET ASSEMBLY AND HAIR CUTTING APPLIANCE

CROSS REFERENCE TO RELATED APPLICATIONS

This application is the U.S. National Phase application under 35 U.S.C. § 371 of International Application No. PCT/EP2019/050475 filed Jan. 10, 2019, published as WO 2019/145150 on Aug. 1, 2019, which claims the benefit of European Patent Application Number 18153367.0 filed Jan. 25, 2018. These applications are hereby incorporated by reference herein.

FIELD OF THE INVENTION

The present disclosure relates to a blade set assembly for a hair cutting appliance. The present disclosure further relates to a hair cutting appliance that is equipped or arranged to be equipped with such a blade set assembly.

More particularly, the present disclosure relates to improvements in hair cutting devices wherein the cutting action is obtained by reciprocating blades, such as clippers and trimmers. More specifically, the present disclosure relates to novel approaches to obtaining an optimal spacing between blades in hair cutting appliances comprising a blade set arrangement involving a movable cutter blade (also referred to as cutter) and a stationary blade (also referred to as guard).

BACKGROUND OF THE INVENTION

Hair cutting appliances, particularly electric hair cutting appliances, are generally known and may include trimmers, clippers and shavers, for instance. Electric hair cutting appliances may also be referred to as electrically powered hair cutting appliances. Electric hair cutting appliances may be powered by electric supply mains and/or by energy storages, such as batteries, for instance. Electric hair cutting appliances are generally used to shave or trim (human) body hair, in particular facial hair and head hair to allow a person to have a well-groomed appearance. Frequently, electric hair cutting appliances are used for cutting animal hair.

From WO 2014/095101 A1 there is known a cutting assembly for a hair clipping device, comprising a stationary cutting blade having a first cutting edge, and a movable cutting blade that is resiliently biased against the stationary cutting blade and that has a second cutting edge that is arranged parallel to the first cutting edge, wherein between the stationary cutting blade and the movable cutting blade a ball bearing is formed that comprises a first bearing recess in the stationary cutting blade and a second the bearing recess in the movable cutting blade. In the bearing recesses, bearing balls are arranged to provide for a smooth running between the stationary cutting blade and the movable cutting blade.

From WO 2017/153482 A1 there is known a similar arrangement of a blade set assembly for a hair cutting appliance. In accordance with the teaching of WO 2017/153482 A1, a desired distance between frontal tips of a stationary blade and a movable blade of the blade set may be accurately defined.

As described in WO 2017/153482 A1, defining and maintaining the tip-to-tip distance between the stationary blade and the movable blade is important to achieve a certain performance and accuracy level. It has been therefore proposed to carefully position and adjust the movable blade and the stationary blade in relation to one another to ensure a precise tip-to-tip distance and a considerably small tolerance range.

As described in WO 2014/095101 A1, providing for a roller bearing or ball bearing between the stationary blade and the movable blade may have the benefit that, in theory, friction between the movable blade and the stationary blade may be reduced, resulting in lower power consumption.

However, it has been observed that not only "vertical" forces, i.e. contact forces due to a biasing member that urges the movable blade against the stationary blade, have an influence on smooth running and power consumption. It has been further observed that a certain "longitudinal" misalignment and/or a certain "longitudinal" relative movement resulting therefrom may cause respective "longitudinal" friction which also contributes to heat generation, power consumption, etc.

There is thus still room for improvement in the design of set assemblies for hair cutting appliances

SUMMARY OF THE INVENTION

It is an object of the present disclosure to provide a design of a blade set assembly, a blade set, and a hair cutting appliance that tackles at least some of the above discussed issues and that preferably enables a high precision assembly, smooth running operation, reduced heat generation and reduced power consumption.

Preferably, the blade set assembly is tolerant to incorrect use and maintains its desired structure and alignment. Preferably, a precise tip-to-tip distance can be defined during manufacture and maintained during operation.

Preferably, blade set assemblies that have been manufactured and assembled in accordance with the present disclosure are durable and arranged to be operated at a high, steady level of performance for a long time. Furthermore, it is desired that no additional adjustment and/or calibration/maintenance efforts are required at the level of the end user.

In a first aspect of the present disclosure there is presented a blade assembly for a hair cutting appliance as defined in independent claim 1. In particular the blade assembly comprises:

- a stationary blade having stationary blade teeth forming a stationary blade leading edge,
- a movable blade having movable blade teeth forming a movable blade leading edge, wherein the movable blade and the stationary blade are arranged on top of one another and operable to be moved with respect to one another in a lateral direction, and
- a guide unit formed between the movable blade and the stationary blade, the movable blade and the stationary blade engaging one another at the guide unit, wherein the guide unit is arranged to set a longitudinal distance between the stationary blade leading edge and the movable blade leading edge and to define a movement path for the relative movement between the stationary blade and the movable blade, and wherein the guide unit comprises at least two longitudinally spaced, laterally extending guideways, each defined between a stationary blade guide surface and a movable blade guide surface that overlap one another.

This aspect is based on the insight that the overlap between the stationary blade guide surface and the movable blade guide surface that form the guideway provides for a positive-fit and hence for and accurate alignment in the longitudinal direction between the movable blade and the stationary blade. The overlap may be regarded as a vertical overlap between the stationary blade and the movable blade that are stacked and layered on top of one another. Needless to say, as used herein, the term vertical shall not be construed to be limiting, but is intended to describe a direction that is basically perpendicular to the basically flat arrangement of the movable blade and the stationary blade, at least in the cutting zone adjacent to the respective leading edges. In other words, the vertical direction is perpendicular to a cutting plane where respective cutting edges of the teeth of the movable blade and the stationary blade cooperate.

Generally, the stationary blade and the movable blade form a blade set having two blades that are arranged to be moved with respect to one another, particularly to be reciprocatingly moved, preferably reciprocatingly moved in a lateral direction. As used herein, the term lateral or lateral direction shall also include respective directions and movement paths that are at least slightly curved. However, at least in certain embodiments, a basically rectilinear reciprocating movement of the movable blade with respect to the stationary blade is intended.

The stationary blade may also be referred to as guard blade. The movable blade may also be referred to as cutter blade. Both the stationary blade and the movable blade are provided with respective teeth having cutting edges that cooperate with one another to cut hair therebetween when the hair cutting appliance is moved through hair.

Generally, the stationary blade is the blade that is facing the skin when the appliance is operated to cut hair. Consequently, the stationary blade is arranged between the movable blade and the skin. Preferably, there is no direct contact between the moving cutter blade and the skin so that the skin is protected by the guard blade.

For trimming applications, a so-called spacing comb may be attached to the blade set. Typically, the spacing comb is arranged at or attached to the stationary blade to define a certain distance between the cutting zone where the stationary blade and the movable blade cooperate with one another and the skin.

Generally, the movable blade is resiliently biased against the stationary blade by means of a biasing element, such as a spring, particularly a torsion spring. The biasing force may be used to further secure the guideway.

As the guide unit, so to say, provides for a positive-fit engagement, in the longitudinal direction, between the movable blade and the stationary blade, a precise, stable and robust alignment and hence an accurate tip-to-tip distance setting is provided.

The guide unit comprises at least two guideways that are longitudinally spaced away from one another. In an embodiment the guide unit comprises two guideways. The respective guideways are each defined between a stationary blade guide surface and a movable blade guide surface. Providing two basically parallel guideways has the benefit that respective guide portions of the movable blade and the stationary blade may engage one another in the vertical direction, whereas in the longitudinal direction forces in both directions (frontal to rear, and rear to frontal) may be accommodated by bearing elements at the respective guideways.

In accordance with an exemplary refinement of this embodiment, two respective stationary blade guide surfaces and two respective movable blade guide surfaces are provided. Hence, in certain embodiments, the stationary blade guide surfaces are arranged between the movable blade guide surfaces. In the alternative, in certain embodiments, the movable blade guide surfaces are arranged between the stationary blade guide surfaces.

The at least one stationary blade guide surface and the at least one movable blade guide surface overlap one another in the vertical direction such that the guideway formed therebetween provides for a defined positive-fit coupling in the longitudinal direction between the stationary blade and the movable blade.

As indicated above, the terms vertical, longitudinal, and lateral are primarily used for illustrative purposes. Generally, the term vertical may be used to indicate a direction between top and bottom. Generally, the term longitudinal may be used to indicate a direction between front and rear. Generally, the term lateral may be used to indicate a direction between a left side and a right side. The above terms are used to describe designs and embodiments of components for hair cutting appliances, using respective device coordinate systems. Needless to say, those skilled in the art may a readily apply respective transformations to describe the aspects, features and embodiments presented herein when being confronted with alternative coordinate systems, orientations and respective associations.

The guide unit is tolerant against longitudinal forces. Accordingly, the relative longitudinal orientation between the movable blade and the stationary blade is maintained due to the overlap between the stationary blade guide surface and the movable blade guide surface.

Rolling elements are arranged at or in the guideway. Preferably, at the guideway, there is no direct contact between the stationary blade and the movable blade, but primarily a mediate contact between the rolling elements arranged therebetween. As a result, friction between the two blades may be further reduced. Power consumption and heat generation may be minimized. Preferably, the rolling elements are arranged as bearing balls. However, in some embodiments, needle bearings, roller bearings, etc. may be utilized.

The rolling elements, particularly the bearing balls, are confined between the stationary blade guide surface and the movable blade guide surface. Preferably, the rolling elements define a vertical and a longitudinal offset between involved guide surfaces of the movable blade and the stationary blade.

The stationary blade guide surface and the movable blade guide surface have a height extension that is greater than a radius of the rolling elements at the guideway. In this way, it can be ensured that the rolling elements are sufficiently blocked by the stationary blade guide surface and the movable blade guide surface in the longitudinal dimension.

In other words, the guideway may be arranged in such a way that any longitudinal forces applied to one of the stationary blade and the movable blade cannot urge or push the rolling elements out of the guideway in the longitudinal direction. That is, the guideway provides in the longitudinal direction a positive-fit lock for the rolling elements, as opposed to WO 2014/095101 A1.

Put differently, if the (effective) height of the stationary blade guide surface and the movable blade guide surface would be smaller than the radius of the rolling elements, particularly the bearing balls, there would be a certain likelihood that a longitudinal force that is sufficiently great can cause a relative longitudinal movement between the movable blade and the stationary blade, including a failure or disengagement of the guideway as the rolling elements may be pushed out of the guideway when a certain longitudinal disengagement force is reached.

It goes without saying that the above applies in particular when the stationary blade guide surface and the movable blade guide surface are basically perpendicular to the longitudinal direction, at least in the area of the contact with the rolling elements. However, the above rationale generally applies as well to arrangements where at least one of the stationary blade guide surface and the movable blade guide surface is at least slightly otherwise inclined.

In still another exemplary embodiment, the guide surfaces of the stationary blade and the movable blade are formed at one of a guide protrusion and a guide recess respectively arranged at one of the movable blade and the stationary blade. This arrangement may include any one of an integral formation of the guide protrusion and/or the guide recess and an attachment of separate parts that form the guide protrusion and or the guide recess.

By way of example, the guide protrusion may be arranged or formed on the part of the movable blade. Accordingly, the guide recess may be arranged or formed on the part of the stationary blade.

In the alternative, the guide protrusion may be arranged or formed on the part of the stationary blade. Accordingly, the guide recess may be arranged or formed on the part of the movable blade.

In still another exemplary embodiment, the guide unit comprises a guide protrusion and a guide recess engaging one another, wherein the guide protrusion and the guide recess define a first and a second guideway therebetween. As a result, the guide protrusion and the guide recess may provide the positive-fit mating of the movable blade and the stationary blade in the longitudinal direction.

In another exemplary embodiment, the guide recess is arranged as a depression in one of the stationary blade and the movable blade having a longitudinal extension that is greater than a longitudinal extension of the guide protrusion. Accordingly, two guideways are defined when the guide recess and the guide protrusion engage one another. Hence, two lines/series of bearing elements may be accommodated and caged between the guide recess and the guide protrusion.

In still another exemplary embodiment, the guide recess is formed between two guide bars protruding from one of the stationary blade and the movable blade towards the other one of the movable blade and the stationary blade. Accordingly, two guideways are defined when the guide recess and the guide protrusion engage one another.

Hence, in accordance with this embodiment, the guide recess is not arranged as a depression/deepening in a main wall of the respective blade, but defined between two protruding tabs.

In accordance with still another exemplary embodiment, the at least one guideway is defined by four guide surfaces among which two guide surfaces are arranged at the stationary blade and two guide surfaces are arranged at the movable blade. Hence, the rolling elements arranged in the guideway are contacted by respective guide surfaces at the frontal side, the rear side, the top side, and the bottom side. As a result, a well-defined lateral guidance for the rolling elements and hence for the blade set is provided.

By way of example, at a frontal guideway that is closer to the tips of the teeth then a rear guideway, the stationary blade may provide a frontal guide surface and a top guide surface, wherein the movable blade provides a rear guide surface and a bottom guide surface. This applies in particular when the guide recess is formed at the stationary blade and the guide protrusion is formed at the movable blade. At the rear guideway, the stationary blade provides a rear guide surface and a top guide surface, and the movable blade provides a frontal guide surface and a bottom guide surface.

In the alternative, when the guide recess is formed at the movable blade and the guide protrusion is formed at the stationary blade, then the movable blade provides a frontal guide surface and a bottom guide surface, whereas the stationary blade provides a rear guide surface and a top guide surface at the frontal guideway. At the rear guideway, the stationary blade provides a frontal guide surface and a top guide surface, and the movable blade provides a rear guide surface and a bottom guide surface.

Each of the movable blade and the stationary blade may provide two adjacent guide surfaces. In some embodiments, the two adjacent guide surfaces have a cross-section resembling a fillet and/or an internal corner/chamfer. In other words, the two adjacent guide surfaces of each of the movable blade and the stationary blade have a general offset angle of about 90° (degrees) therebetween, at least in the contact zone with the bearing elements.

As discussed above, the guide protrusion (male part) may be arranged at any of the stationary blade and the movable blade, and the guide recess (female part) may be arranged at the opposite one of the stationary blade and the movable blade to form the guide unit. Generally, the guide protrusion extends at least partially into the guide recess.

The longitudinal relative position of the movable blade and the stationary blade defines the tip-to-tip distance. The guide unit may be referred to as lateral guide unit as the guide unit enables a defined lateral relative movement between the movable blade and the stationary blade.

Generally, each of the guideways may accommodate a plurality of rolling elements. At least in some embodiments, four contact points (frontal, rear, top, and bottom) are defined for the rolling elements, particularly the ball bearings. Needless to say, due to inherent tolerances and inaccuracies, in practice, it is not unlikely that at least for some of the rolling elements not always four contacts are present. Hence, the above is not to be construed in a limiting sense. Further, in at least some embodiments, also a left side lateral limit and a right side lateral limit for the rolling elements may be defined, particularly for loss proof purposes.

Generally, the movable blade and the stationary blade engage one another at the guide unit and enclose the rolling elements, thereby defining the guideways.

In accordance with yet another exemplary embodiment, the blade set assembly further comprises a decoupling unit that decouples a movement of the movable blade from a biasing element that urges the movable blade against the stationary blade.

As indicated above, the biasing element is arranged to ensure a tight contact between the stationary blade and the movable blade, particularly in the cutting zone therebetween. Generally, the biasing element is mounted to and/or supported at a portion of the hair cutting appliance that is stationary, i.e. not moved together with the movable blade. By way of example, the biasing element may be arranged as a torsion spring having at least one arm that acts on the movable blade to urge the movable blade against the stationary blade.

As the movable blade is moving when the appliance is operated, a certain feedback may be present at the biasing element. As a result, friction and heat generation may achieve a certain level, increasing the required power to operate the appliance. It would be therefore beneficial to provide for a decoupling between the biasing element and the movable blade, in terms of a lateral feedback. Preferably, the decoupling unit is arranged to transmit the biasing force, but to decouple the lateral movement of the movable blade from the biasing element. In other words, it is desired that the decoupling unit is arranged to decouple a lateral force transmission/feedback between the movable blade and the biasing element. More preferably, the decoupling unit is further arranged to decouple also a longitudinal force transmission between the movable blade and the biasing element.

Hence, in at least some embodiments, the decoupling unit enables a defined distribution and control of interaction between the biasing element and the movable blade. In this way, an over-determination of the joint between the biasing element and the movable blade may be avoided.

It is not necessary to use the biasing element to define the longitudinal position of the movable blade with respect to the stationary blade as this is ensured by the guide unit. Further, while it is appreciated in some embodiments that the biasing element, so to say, dampens the quick reciprocating movement of the movable blade, it may be desired in other embodiments to reduce or even eliminate a respective dampening effect.

In yet another exemplary embodiment, the decoupling unit comprises a guide bar arranged between the biasing element and the movable blade, wherein the biasing element pushes the guide bar against the movable blade. Hence, the biasing element does not directly contact the movable blade, as the guide bar is arranged therebetween. The guide bar may also be referred to as guide plate.

In yet another exemplary embodiment, the decoupling unit comprises at least one guideway for rolling elements, particularly for bearing balls. The rolling elements may minimize any friction between the movable blade and the guide bar and hence between the movable blade and the biasing element.

In yet another exemplary embodiment, the decoupling unit is arranged to transmit substantially a vertical push force applied by the biasing element. Preferably, the decoupling unit is arranged to exclusively transmit the vertical push force, and to prevent (decouple) longitudinal forces and lateral forces from being transmitted. Hence, longitudinal forces and or lateral forces may be prevented from being submitted between the movable blade and the biasing element, at least to a certain extent.

In still another exemplary embodiment, the decoupling unit und the guide unit are formed at opposite sides of the movable blade, preferably at the same longitudinal level. In still another exemplary embodiment, the decoupling unit is formed at two opposing walls between the movable blade and the guide bar, wherein the decoupling unit comprises a guide protrusion formed at a first wall of the opposing wall, and a guide recess formed at a second wall of the opposing walls, and wherein the guide protrusion extends into the guide recess.

In a further aspect of the present disclosure there is presented a hair cutting appliance comprising a blade set assembly in accordance with at least one embodiment as disclosed herein.

Preferably, the hair cutting appliance is a hand-held electrically powered hair cutting appliance. Typically, the hair cutting appliance comprises an elongated housing and a cutting head at a top end thereof where the blade set is provided. Typically, the blade set comprises at least one stationary blade and at least one movable cutter blade that is operable to be moved with respect to the stationary blade to cut hair. The elongated housing further comprises a bottom end which is opposite to the top end thereof. Further, a front side and a rear side are provided. When the hair cutting appliance is in operation, typically the top side, where the blade set is arranged, contacts the to-be-groomed skin portion in a direct or mediate (i.e. via an attachment comb) fashion. The front side is typically facing the skin portion, when the appliance is in use. Consequently, the rear side is typically facing away from the skin when the hair cutting appliance is in operation.

When the hair cutting appliance is in operation, the stationary blade is not moved in a reciprocating fashion with respect to a housing thereof. Rather, the cutter blade is operated and moved with respect to the stationary blade and with respect to the housing in a reciprocating fashion. As a result, a relative movement between the stationary blade and the cutter blade is generated for the hair cutting operation.

BRIEF DESCRIPTION OF THE DRAWINGS

These and other aspects of the disclosure will be apparent from and elucidated with reference to the embodiments described hereinafter. In the following drawings.

DETAILED DESCRIPTION OF THE EMBODIMENTS

Figure 1:
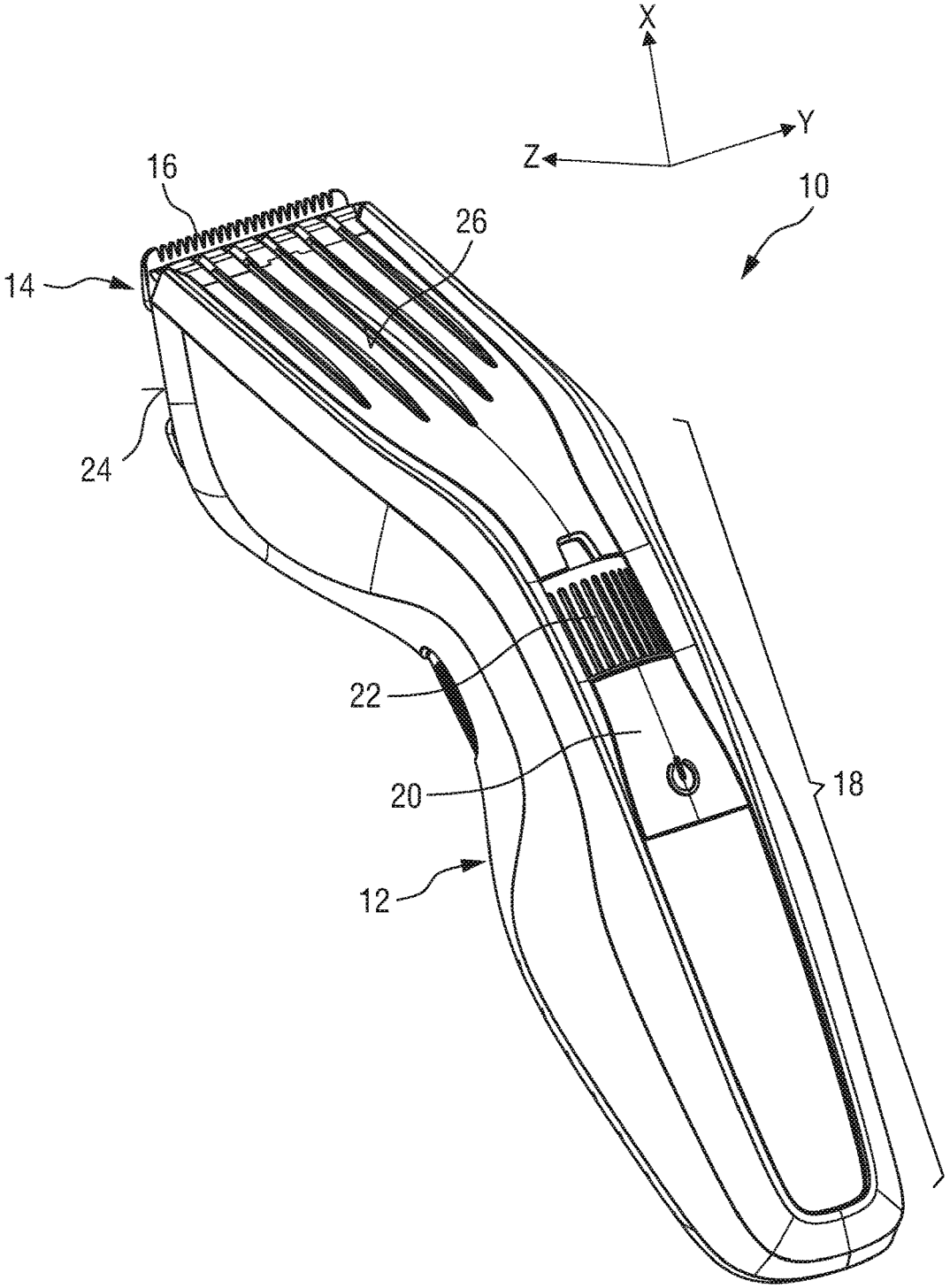
Fig. 1 (prior art)
FIG. 1 shows a schematic perspective view of an exemplary embodiment of an electric hair cutting appliance.

FIG. 1 shows a schematic perspective rear view of a hair cutting appliance 10, particularly an electrically operated hair cutting appliance 10. The appliance 10 may also be referred to as hair clipper or hair trimmer. The appliance 10 comprises a housing or housing portion 12 having a generally elongated shape. At a first, top end thereof, a cutting head 14 is provided. The cutting head 14 comprises a blade set assembly 16. The blade set assembly 16 comprises a movable blade and a stationary blade (refer to FIG. 3) that may be moved with respect to each other to cut hair. At a central portion and a second, bottom end of the housing 12, a handle or grip portion 18 is formed. A user may grasp or grab the housing 12 at the grip portion 18.

The appliance 10 in accordance with the exemplary embodiment of FIG. 1 further comprises operator controls. For instance, an on-off switch or button 20 may be provided. Furthermore, in case the appliance 10 is provided with a comb length adjustment mechanism, a length adjustment control 22 may be provided at the housing 12 of the appliance 10. In the embodiment of FIG. 1, the length adjustment control 22 is arranged as a length adjustment wheel.

A front side of the housing portion 12 is indicated in FIG. 1 by reference numeral 24. An opposite rear side is indicated by reference numeral 26. Consequently, for illustrative purposes, the housing 12 of the hair cutting appliance 10 comprises a top side, where the blade set assembly 16 is mounted, a bottom side that is opposite to the top side, a front side 24 which typically faces the skin of the to-be-groomed subject when the appliance 10 is in operation, and a rear side 26 that is opposite to the front side 24. However, for the avoidance of doubts, it is to be noted that a blade set assembly coordinate system, and also respective position and orientation indications, may be different from the appliance's 10 coordinate system, and therefore also from respective position and orientation indications. As can be seen already in FIG. 1, the blade set assembly 16 is considerably inclined with respect to the housing 12. In the following, the general design and orientation of the blade set assembly 16 shall for the basis for a coordinate system and for directional information/orientation information use to describe several aspects and embodiments in accordance with the present disclosure.

As shown in at least some Figures discussed herein, for illustrative purposes, a coordinate system (Cartesian coordinate system) X-Y-Z is provided. The coordinate system X-Y-Z is used in the following for describing orientations and locations of components of the hair cutting appliance 10, particularly of the blade set assembly 16 thereof. However, as can be already seen from FIG. 1, not in each case a perfect match of components or parts of the appliance 10 with any of the axis X-Y-Z is provided. By way of example, the housing 12 may exhibit an elongated but somewhat curved shape for ergonomic and design reasons.

Therefore, a main elongation direction of the housing 12 does not perfectly match the direction of the X-axis and the Z-axis, but will be rather somewhat inclined of curved in relation thereto. It goes without saying that the skilled person is capable of adapting or, if necessary, transforming or converting the coordinate system X-Y-Z when being confronted with new embodiments, illustrations and/or orientations as the coordinate system X-Y-Z is merely an illustrative means for describing elements of the presented exemplary embodiment of the appliance 10 and their interrelation.

For illustrative purposes, the X-axis will be hereinafter associated with a longitudinal or length direction. Accordingly, the Y-axis will be hereinafter associated with a lateral or width direction. Accordingly, the Z-axis will be hereinafter associated with a height or vertical direction. The coordinate system X-Y-Z describes main extension directions of the blade set assembly 16.

Figure 2:
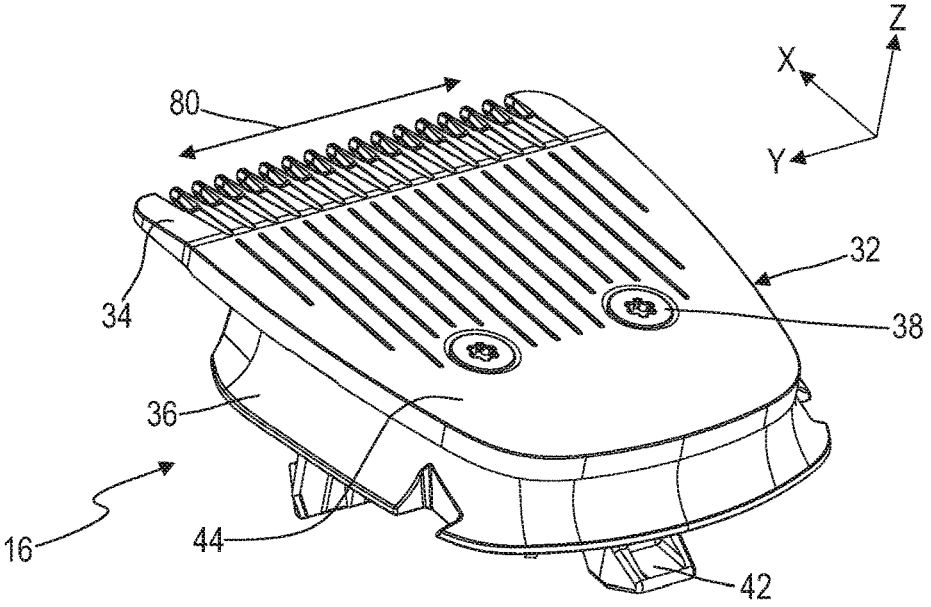
Fig. 2 (prior art)
FIG. 2 shows a perspective top view of an exemplary embodiment of a blade set assembly.
Figure 3:
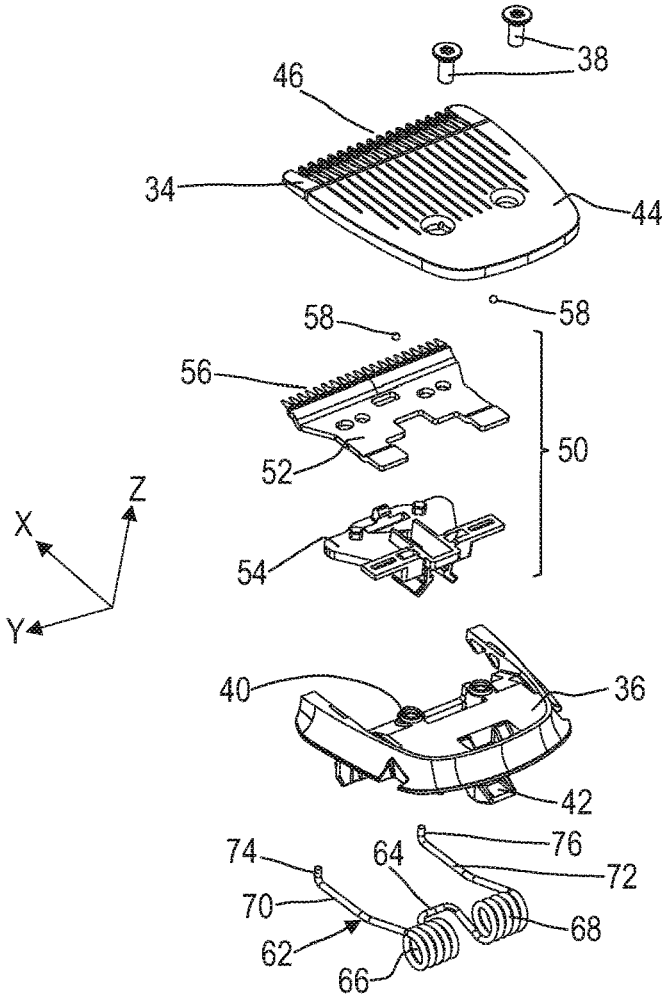
Fig. 3 (prior art)
FIG. 3 shows an exploded view of the blade set assembly of FIG. 2 in a reduced size representation.
Figure 4:
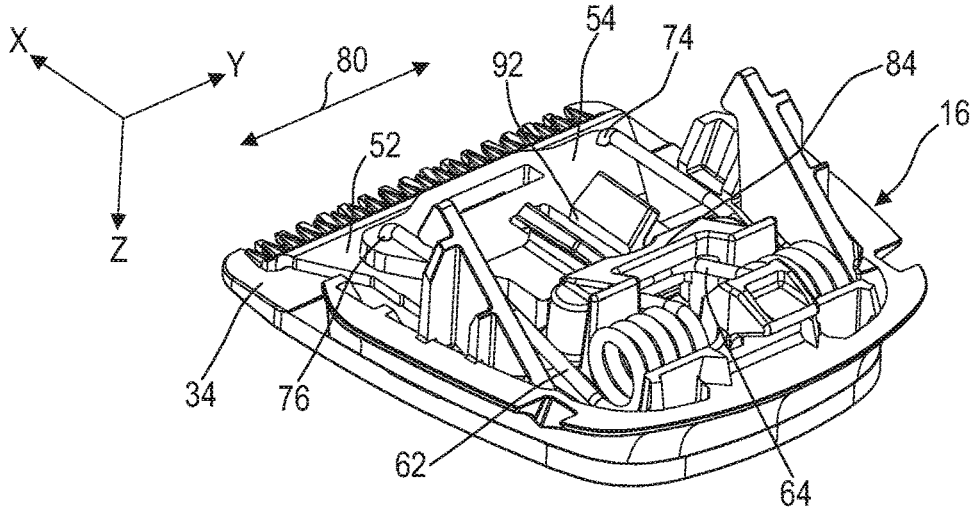
Fig. 4 (prior art)
FIG. 4 shows a perspective bottom view of the blade set assembly of FIG. 2.
Figure 5:
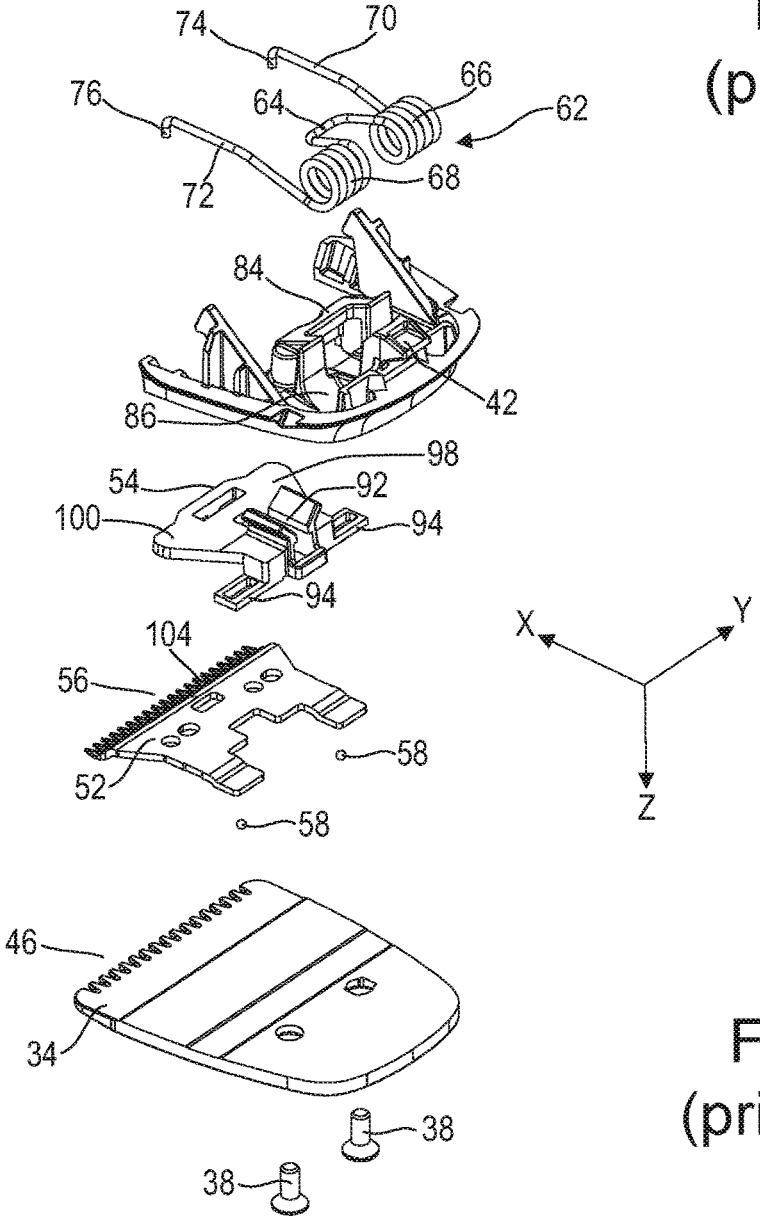
Fig. 5 (prior art)
FIG. 5 shows an exploded view of the arrangement of FIG. 4 in a reduced size representation.

With particular reference to FIGS. 2 to 5, an exemplary arrangement of a blade set assembly 16 for a hair cutting appliance 10 will be explained and further detailed. FIG. 2 is a perspective top and front view. FIG. 3 is an exploded view of the arrangement of FIG. 3. FIG. 4 is a perspective bottom and rear view. FIG. 5 is an exploded view of the arrangement of FIG. 4.

The blade set assembly 16 illustrated in FIGS. 2 to 5 is arranged to be coupled with a housing 12 of a hair cutting appliance 10, refer also to FIG. 1.

The blade set assembly 16 comprises a base component 32 which is, when the appliance 10 is operated, attached to the housing 12 thereof which may involve a fixed or firm attachment. The base component 32 comprises a stationary blade 34 and a support part 36. The stationary blade 34 may be also referred to as guard. The support part 36 may be also referred to as support frame. The stationary blade 34 is attached to the support part 36 by fasteners 38 which engage corresponding recesses 40 at the support part 36, refer also to FIG. 3. In the illustrated exemplary embodiment, the fasteners 38 are arranged as screws.

The support part 36 comprises mounting features 42 through which the support part 36 and, consequently, the base component 32, may be attached to the housing 12 in a detachable fashion, at least in some embodiments.

The stationary blade 34 comprises a toothed section comprising a series of teeth 46. Further, a support wall 44 is provided. The toothed section extends from the support wall 44 in the longitudinal direction X.

The blade set assembly 16 further comprises a movable component 50, refer to FIG. 3. The movable component 50 comprises a cutter blade 52. Further, in the exemplary embodiment of FIGS. 2 through 5, the movable component 50 further comprises a contact bridge 54 which is preferably arranged as a plastic contact bridge. Further, at the cutter blade 52, a toothed section comprising a series of teeth 56 is provided. The teeth 46 of the stationary blade 34 and the teeth 56 of the cutter blade 52 are moved with respect to one another in a reciprocating fashion when the blade set assembly 16 is operated, refer also to the double arrow 80 in FIG. 2 and in FIG. 4.

The contact bridge 54 may be also referred to as driving bridge. More generally, the contact bridge 54 may be referred to as contact element. In at least some embodiments, the contact bridge 54 is attached to or forms a part of the movable component 50.

As can be best seen in FIG. 3 and in FIG. 5, bearing balls 58 may be provided is exemplary embodiments as a bearing means for facilitating the relative movement between the stationary blade 34 and the cutter blade 52.

So as to secure and define a relative assembly position between the stationary blade 34 and the cutter blade 52, a biasing element 62 is provided which is arranged as a spring element. More particularly, the biasing element 62 may be arranged as a leg spring element. At the biasing element 62, a retaining portion 64 is provided which may be also referred to as retaining arm or retaining bracket. The retaining portion 64 is arranged at a central portion of the biasing element 62. Adjacent to the retaining portion 64, a first spiral portion 66 and a second spiral portion 68 is provided. The spiral portions 66, 68 may be also referred to as resilient or flexible portions.

At a first lateral side of the biasing element 62, a first deflection arm 70 is provided. At a second lateral side of the biasing element 62, a second deflection arm 72 is provided. A first insertion end 74 is provided at the first deflection arm 70. A second insertion end 76 is provided at the second deflection arm 72. The deflection arms 70, 72 and, consequently, the insertion ends 74, 76 are spaced away from one another in the lateral direction Y. In the embodiment as shown in FIGS. 2 to 5, the spiral portions 66, 68 define a common axis which is basically parallel to the lateral direction Y. The deflection arms 70, 72 basically extend in the longitudinal direction X, at least in the neutral orientation of FIGS. 3 and 5. The insertion ends 74, 76 basically extend in the height (vertical) direction Z. Needless to say, alternative embodiments and arrangements of the biasing element 62 may be envisaged, involving non-wire spring element, for instance flat spring elements, plastic spring elements, and composite metal-plastic spring elements.

The biasing element 62 secures and maintains a defined relative orientation between the stationary blade 34 and the cutter blade 52 which also applies when the blade set assembly 16 is operated involving a movement of the cutter blade 52 in a reciprocating fashion in the movement direction 80 with respect to the stationary blade 34. Hence, at least the deflection arms 70, 72 are swiveled or deflected when the blade set assembly 16 is operated. As a consequence, the insertion ends 74, 76 are reciprocatingly moved along with the cutter blade 52, wherein a movement path of the insertion ends 74, 76 is substantially parallel to the lateral direction Y but also involves a small component in the longitudinal direction X, as will be discussed further below in more detail.

As can be best seen in FIG. 4, the insertion ends 74, 76 of the biasing element 62 engage (or are inserted in) the contact bridge 54 which is attached to the cutter blade 52. This may involve that the insertion ends 74, 76 are driven into the contact bridge 54.

Further, as can be best seen in FIG. 4 and in the corresponding exploded view of FIG. 5, the retaining portion 64 of the biasing element 62 is, in the mounted state, retained by or supported at a retaining section 84 of the support part 36. The retaining section 84 may be also referred to as retaining recess or retaining seat. Further, a respective receiving recess or mounting recess 86 for each of the spiral portions 66, 68 of the biasing element 62 is provided at the support part 36. As can be already concluded from the arrangement of FIG. 4, when the biasing element 62 is received at the base component 62 which involves that the retaining portion 64 of the biasing element 62 is received at the retaining section 84 in a pre-tensioned or preloaded fashion, a resulting torque or force at the deflection arms 70, 72 may be generated. Typically, the retaining portion 64 and the deflection arms 70, 72 of the biasing element 62 tend to move (swivel) away from one another and to rotate in an opposite fashion, thereby "unwinding" the spiral or coil portions 66, 68.

Having explained the general structure and arrangement of a hair cutting appliance herein before with reference to FIGS. 1 to 5, reference is now made to FIGS. 6 to 15, elucidating and illustrating embodiments of the blade assemblies having guide units to provide for a defined relative movement between the involved blades.

It goes without saying the single features disclosed in the context of a respective embodiment may be combined with any of the other embodiments, also in isolated fashion, thereby forming further embodiments that still fall under the scope of the present disclosure.

A first embodiment of a blade set assembly 116 is illustrated in FIGS. 6 to 9. As with the blade set assembly 16 described herein before, also the blade set assembly 116 is arranged to be attached to a hair cutting appliance 10.

The blade set assembly 116 comprises a stationary blade 134 and a movable blade 152 that form a blade set. The stationary blade 134 is arranged to be coupled with a support part 136. Both, the stationary blade 134 and the support part 136 may be attached to a housing of a hair cutting appliance.

Figure 9:
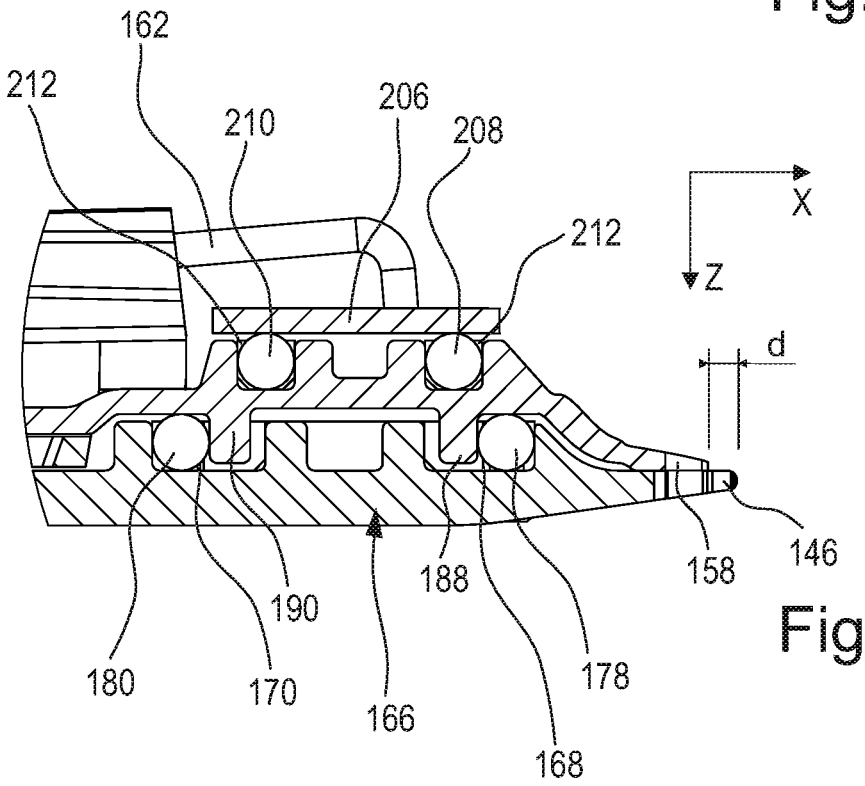
FIG. 9 shows a cross-sectional detail side view of a frontal portion of the blade set assembly along the line IX-IX in FIG. 8.

The stationary blade 134 comprises stationary blade teeth 146 that form a stationary blade leading edge 148. The movable blade 152 comprises movable blade teeth 156 that form a movable blade leading edge 158. The leading edges 156 and 158 are defined by respective tips of the teeth 146 and 156. The distance between the leading edges 156, 158 is indicated in FIG. 9 by d.

A driver 154 is attached to the movable blade 152 to transmit a reciprocating operating movement to the movable blade 152 to move the movable blade 152 with respect to the stationary blade 134.

As with the embodiment of the blade set assembly 16 discussed herein before, also the blade set assembly 116 comprises a biasing element or biasing element 162. The biasing element 162 may be arranged as a spring, particularly a torsion spring having at least one arm that urges the movable blade 152 against the stationary blade 134.

Between the stationary blade 134 and the movable blade 152, a guide unit 166 is provided. The guide unit 166 comprises at least one guideway 168, 170. In the embodiment illustrated in FIGS. 6 to 9, a first guideway 168 and a second guideway 170 are provided that are spaced away from one another in the longitudinal direction (X-direction). The at least one guideway 168, 170 is arranged as a guide slot. At the stationary blade 134, guide surfaces 172 are formed. At the movable blade 152, guide surfaces 174 are formed. The guide surfaces 172, 174 cooperate with one another to define the at least one guideway 168, 170.

In the at least one guideway 168, 170, rolling elements 178, 180 are arranged. The rolling elements 178, 180 are arranged to be contacted by the guide surfaces 172, 174. The rolling elements 178, 180 are arranged between opposing guide surfaces 172, 174 of the stationary blade 134 and the movable blade 152, respectively.

Hence, a rolling contact between the movable blade 152 and the stationary blade 134 is possible that reduces friction, heat generation, wear, etc. Further, the tip-to-tip distance d (refer to FIG. 9) is accurately defined and maintained during the operation of the blade set assembly 116.

The rolling elements 178, 180 may be arranged as bearing balls. The rolling elements 178, 180 are arranged in slot-like channels jointly defined by the stationary blade 134 and the movable blade 152.

As shown in any of FIGS. 6 to 9, two rows or series of rolling elements 178, 180 are provided. Rolling elements 178 are assigned to the guideway 168. Rolling elements 180 are assigned to the guideway 170.

In the exemplary embodiment of result in FIGS. 6 to 9, the at least one guideway 168, 170 of the guide unit 166 is formed by a guide recess or guide recesses 184, and a guide protrusion or guide protrusions 186 that engage one another to retain the rolling elements 178, 180 therebetween. Hence, due to the guide unit 166, the stationary blade 134 and the movable blade 152 may engage one another to provide a positive-fit mating that prevents relative movement in the longitudinal direction (X-direction).

Figure 6:
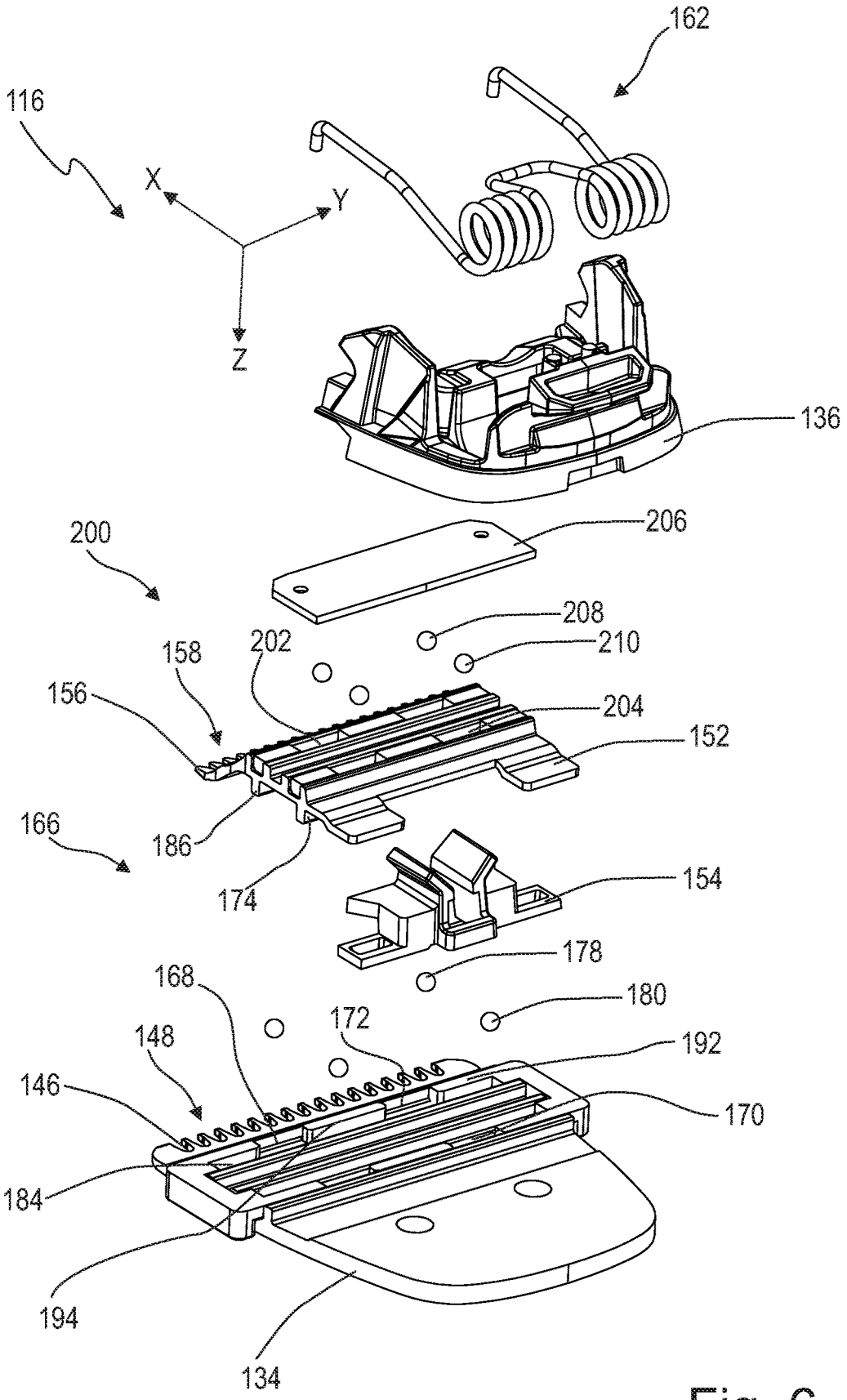
FIG. 6 shows a perspective exploded rear view of a blade set assembly having a guide unit in accordance with the present disclosure.
Figure 7:
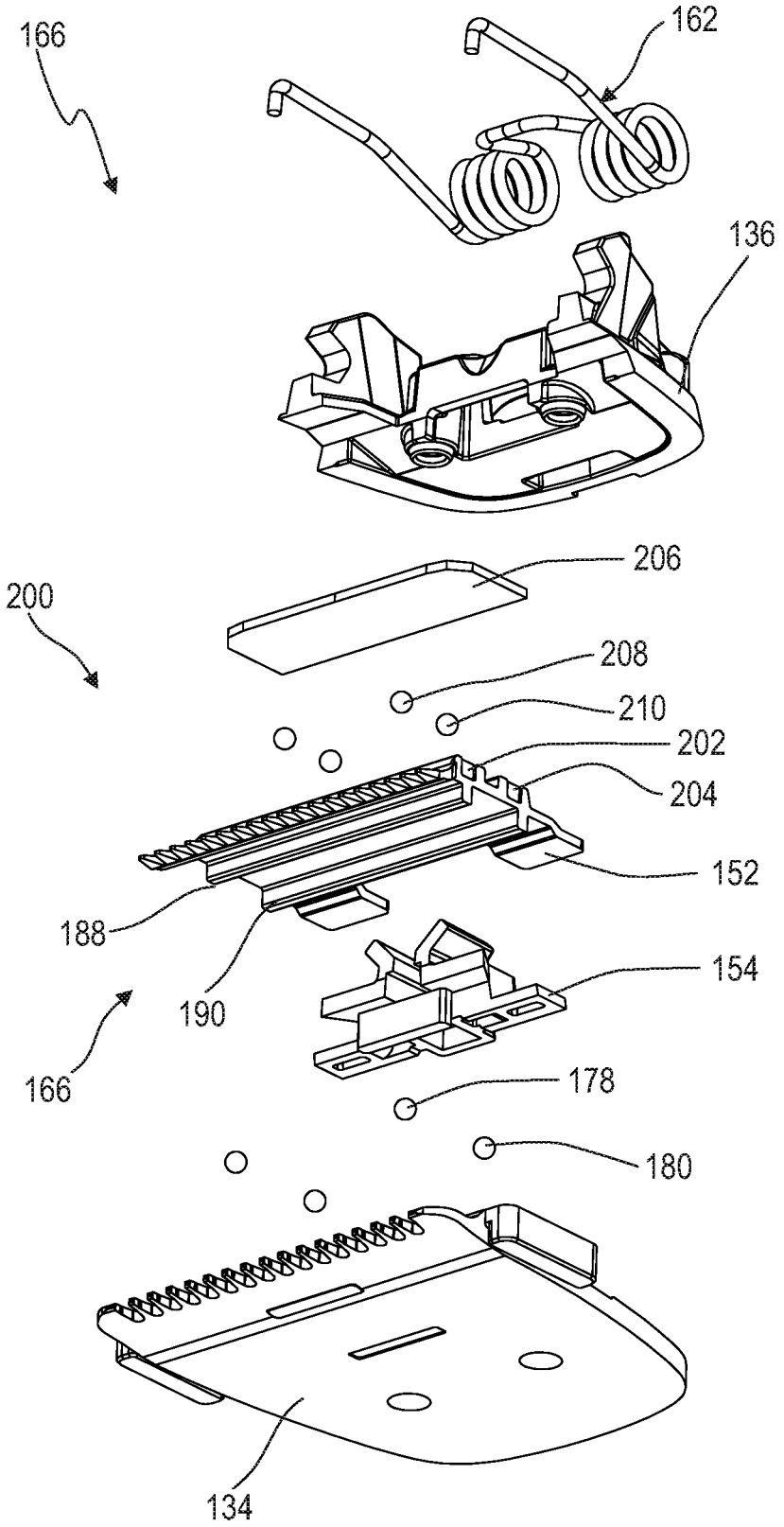
FIG. 7 shows a perspective exploded frontal view of the arrangement of FIG. 6.
Figure 8:
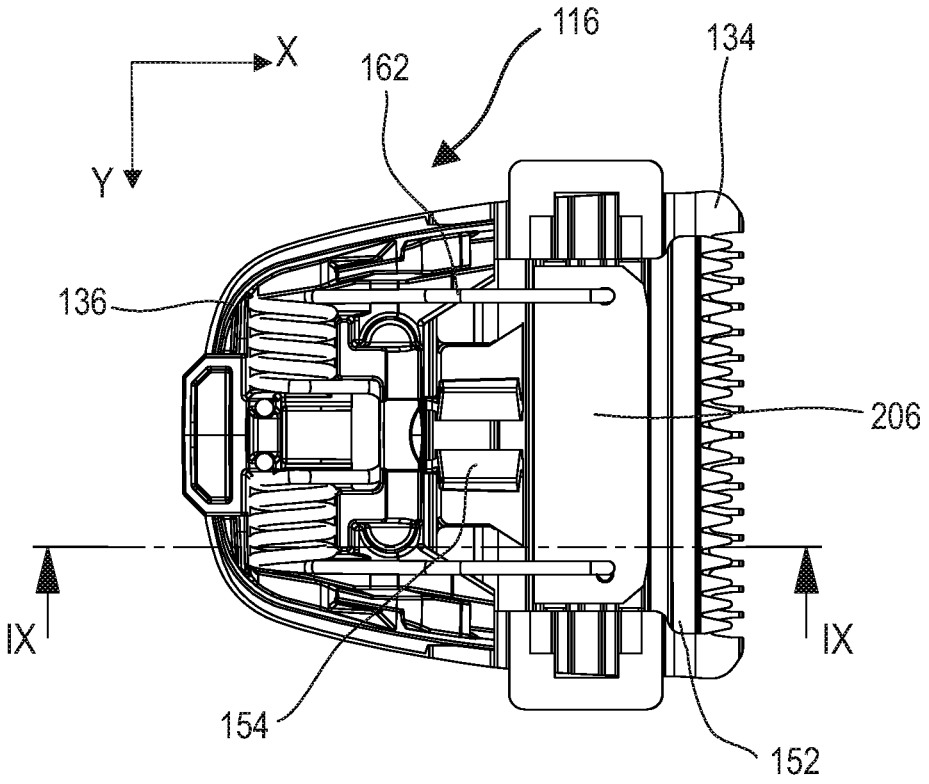
FIG. 8 shows a bottom view of the arrangement of FIG. 6.

As can be seen in FIG. 7, the guide protrusion 186 is defined by two guide bars 188, 190 that are spaced away from one another, and that engage respective portions/slots of the guide recess 184 of the stationary blade 134 (refer to FIG. 6).

As can be best seen in FIG. 9, the guide unit 166 is arranged in such a way that the guide recess 184 and the guide protrusion 186 are arranged and engage one another in such a way that a certain overlap in the vertical direction (Z-direction) it is provided that ensures that any force applied in the X-direction does not disengage or detach the involved elements of the guide unit 166.

By way of example, a height of the guide protrusion 186 is at least half the diameter of the rolling elements 178, 180. Similarly, a depth of the guide recess 184 is at least half the diameter of the rolling elements 178, 180. The depth of the guide recess 184 corresponds to the height extension (vertical extension) of the involved guide surfaces 172. Similarly, the height of the guide protrusion 186 corresponds to the vertical extension of the involved guide surfaces 174 and the guide bars 188, 190.

Generally, the terms guide recess and guide protrusion are not intended to be limiting. Rather, as can be already seen in the exemplary embodiment of FIGS. 6 to 9, also the guide recess may be provided with elevations/projections that engage a slot or depression formed in the guide protrusion. Generally, the guide recess and the guide protrusion engage and overlap one another in the vertical direction to reliably retain the rolling elements therebetween in a manner insensitive to longitudinal forces.

It can be further seen in FIG. 9 that the guideways 168, 170 of the guide unit 166 may be arranged in such a way that in total four contacts for the rolling elements 178, 180 are provided, two of which defined by the stationary blade 134, and the other ones defined by the movable blade 152. By way of example, for the rolling element 178 shown in FIG. 9, the guideway 168 involves a frontal contact and a top contact at the stationary blade 134, and a rear contact and a bottom contact at the movable blade 152. Accordingly, for the rolling element 180 shown in FIG. 9, the guideway 170 involves a rear contact and a top contact at the stationary blade 134, and a frontal contact and a bottom contact at the movable blade 152.

It is to be noted in this context that in accordance with the view orientation of FIG. 9, the top side of the blade set assembly 116 is at the bottom, and the bottom side of the blade set assembly 116 is at the top of the illustration. Further, in accordance with the view orientation of FIG. 9, the front side is at the right and the rear side is at the left of the illustration.

The opposite guide surfaces 172, 174 that accommodate therebetween the rolling elements 178, 180, are designed to be sufficiently high (Z direction) to enable a contact with the rolling elements 178, 180 at outermost points of the sectional shape shown in FIG. 9. The front and rear contact points are at a height position that corresponds approximately to half the diameter of the section of the rolling elements 178, 180 shown in FIG. 9.

Reference is again made to the perspective exploded view of FIG. 6 to explain that the guideways 168, 170 of the guide unit 166 may be arranged as interrupted slots. By way of example, inserts 192, 194 may be disposed in basically continuous slots to define respective (sub-)sections of the guideways 168, 170. Hence, defined movement ranges for the rolling elements 178, 180 may be provided. In this way, a defined minimum (lateral) distance between respective rolling elements 178, 180 of a particular guideway 168, 170 may be provided.

It is to be noted that in the exemplary embodiment illustrated in FIGS. 6 to 9, four rolling elements 178, 180 are used two of which are respectively assigned to one of the two guideways 168, 170. Hence, a certain load distribution may be achieved.

In some exemplary embodiments, the design of the blade set assembly 116 may be augmented with a decoupling unit 200 interposed between the biasing element 162 and the movable blade 152. As described herein before, the biasing element 162 is primarily provided to generate a certain bias or tension that urges the movable blade 152 against the stationary blade 134.

The decoupling unit 200 also comprises at least one guideway 202, 204 forming a guide between a guide plate 206 and the movable blade 152. The guide plate 206 is engaged by respective engagement ends of torsion arms of the biasing element 162. The guideways 202, 204 extend in the lateral direction (Y-direction). In the guideways 202, 204, rolling elements 208, 210 are provided. The guideways 202, 204, so to say, decouple relative movement between the spring element 162 and the movable blade 152 in the Y-direction. Further, due to the basically flat design of the guide plate 206 at the site thereof that faces the movable blade 152, the decoupling unit 200 also decouples relative movement between the spring element 162 and the movable blade 152 in the X-direction.

At the movable blade 152, the decoupling unit 200 involves a guide recess 212 that defines slots forming the guideways 202, 204.

Providing the blade set assembly 116 with the decoupling unit 200 has the benefit that potentially disturbing interferences between the movement of the movable blade 152 and the desired biasing function of the biasing element 162 may be reduced or even avoided.

In the following, further embodiments of the blade set assemblies having guide units between the respective stationary blade and the movable blade will be presented and illustrated in more detail. However, the main focus is on components and features that differ from their respective counterparts in the exemplary embodiment already illustrated with reference to FIGS. 6 to 9. Apart from that, regarding the general design and structure of the blade set assemblies, the foregoing description applies as well.

Figure 10:
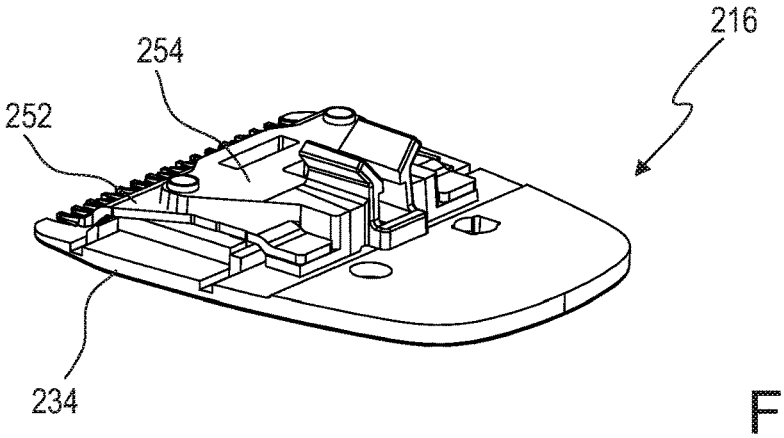
FIG. 10 shown a perspective rear view of another embodiment of a blade set assembly having a guide unit.
Figure 11:
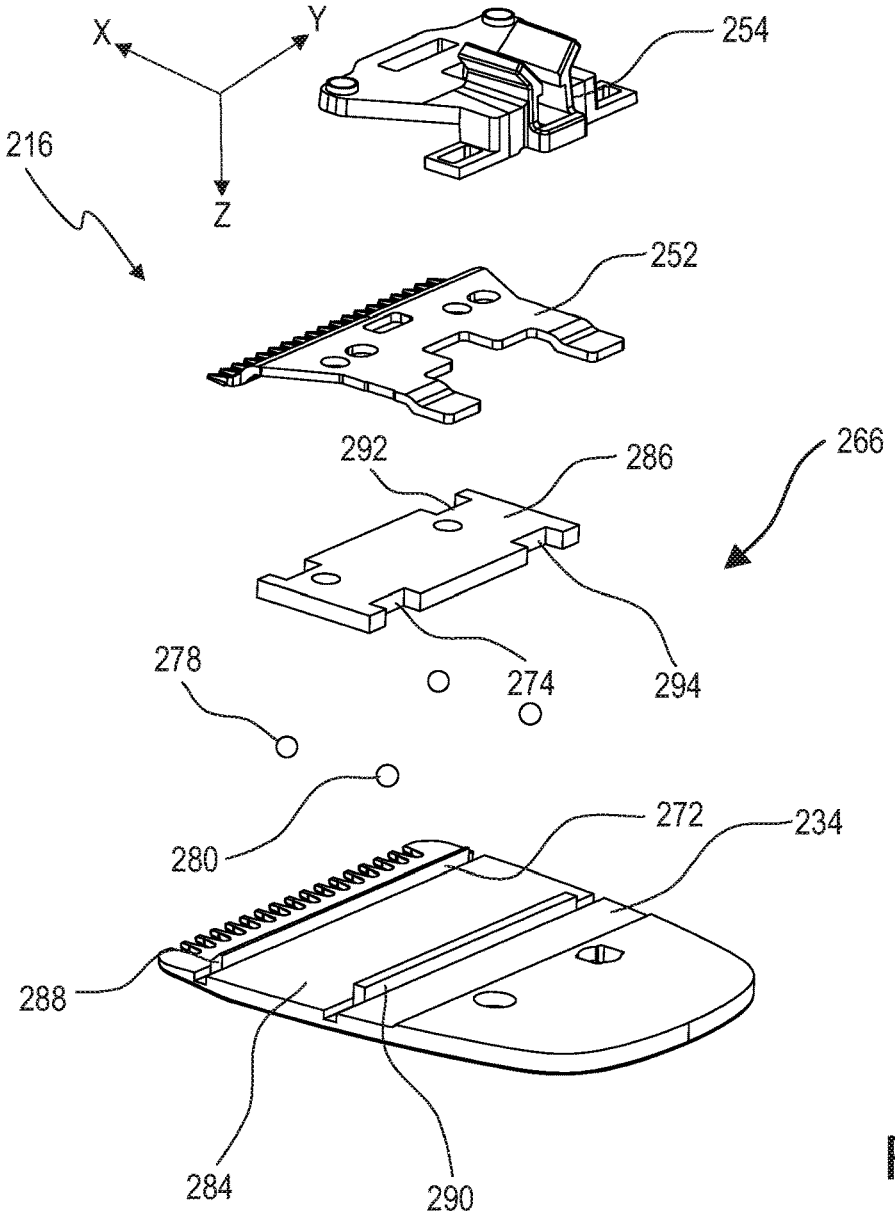
FIG. 11 shows a perspective exploded rear view of the arrangement of FIG. 10.
Figure 12:
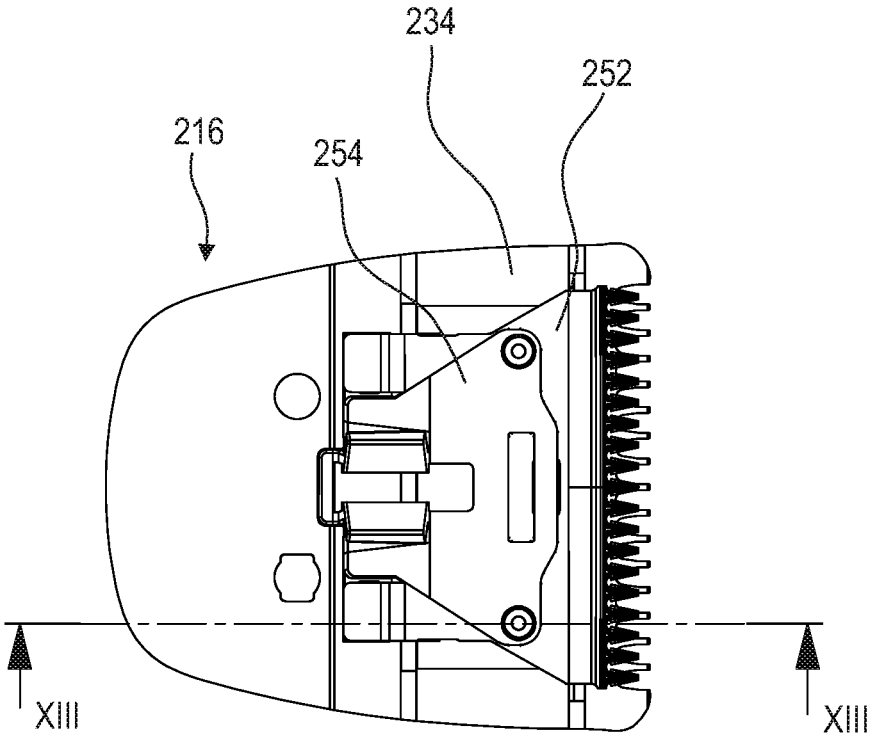
FIG. 12 shows a bottom view of the arrangement of FIG. 10.

With reference to FIGS. 10 to 13, a further exemplary embodiment of a blade set assembly designated by 216 will be described. FIG. 10 and FIG. 11 show perspective bottom and rear views, whereas FIG. 11 shows an exploded configuration of the blade set assembly 216 of FIG. 10.

The blade set assembly 216 comprises a stationary blade 234 and a movable blade 252. A driver part 254 is provided that is arranged to be coupled with the movable blade 252 to set the movable blade 252 into motion with respect to the stationary blade 234.

A guide unit 266 is provided between the stationary blade 234 and the movable blade 252. The guide unit 266 comprises two guideways 268, 270, refer also to FIG. 13. The guideways 268, 270 are arranged as slots that accommodate rolling elements 278, 280. In the guideways 268, 270, guide surfaces 272, 274 are provided that define frontal and rear abutment surfaces for the rolling elements 278, 280.

The guideways 268, 270 of the guide unit 266 are defined by a guide recess 284 at the stationary blade 234 and a guide protrusion 286 at the movable blade 252. As can be seen in the exploded view of FIG. 11, the guide protrusion 286 is a separate part that is attached to a main part of the movable blade 252.

The guide recess 284 at the stationary blade 234 is formed by two guide bars 288, 290 that are spaced away to accommodate therebetween the guide protrusion 286 and two rows of rolling elements 278, 280.

To define a certain position and movement range for the rolling elements 278, 280, cutouts 292, 294 are formed in the plate like guide protrusion 286 to define respectively delimited slots. In each of the cutouts 292, 294, a rolling element 278, 280 is arranged in the assembled state of the guide unit 266 and the blade set assembly 216.

Figure 13:
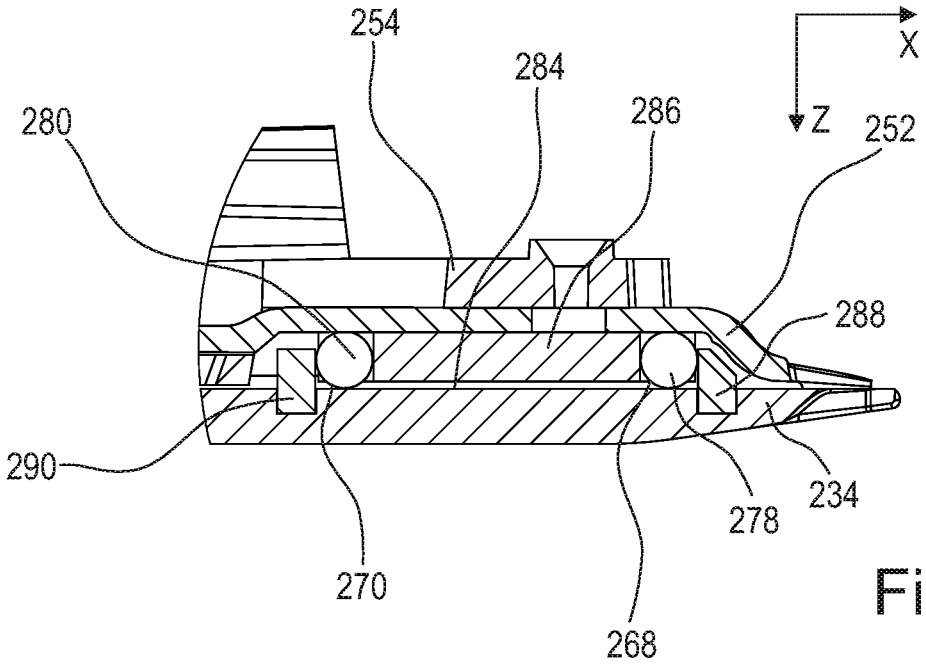
FIG. 13 shows a cross-sectional detail side view of a frontal portion of the blade set assembly along the line XII-XII in FIG. 12.

As can be best seen in FIG. 13, the guide unit 266 provides respective frontal and rear contact surfaces (guide surfaces 272, 274) for the rolling elements 278, 280. Hence, the longitudinal position (X-position) is accurately and reliably defined and maintained during the operation of the blade set assembly 216.

Figure 14:
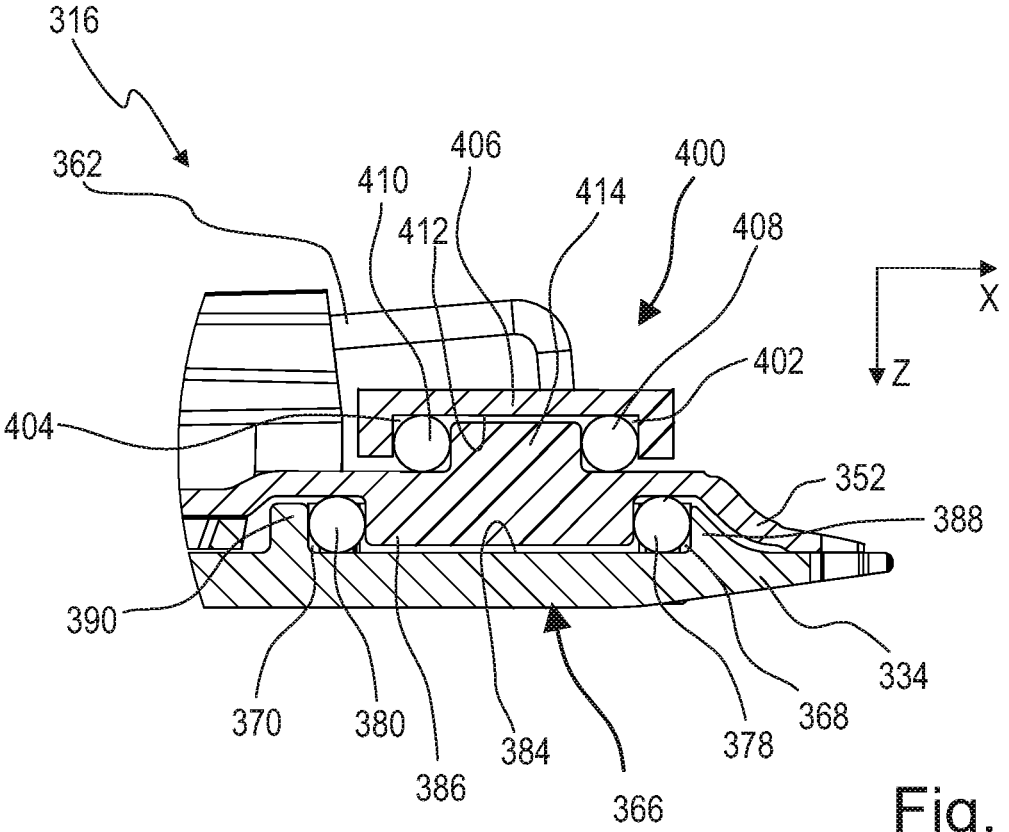
FIG. 14 shows a cross-sectional detail side view of a frontal portion of a further embodiment of a blade set assembly.
Figure 15:
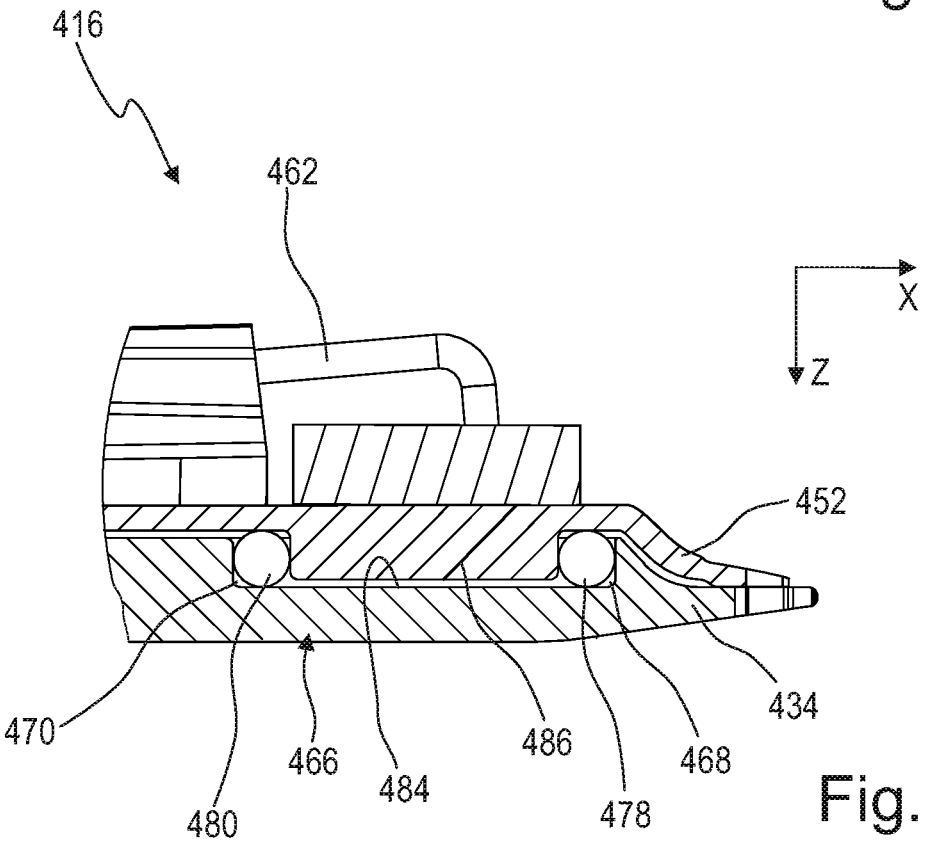
FIG. 15 shows a cross-sectional detail side view of a frontal portion of yet a further embodiment of a blade set assembly.

Reference is now made to FIGS. 14 and 15, illustrating further exemplary embodiments of blade set assemblies 316, 416. Both, FIGS. 14 and 15 show cross-sectional partial side views of a frontal portion of the respective blade set assemblies, refer also to FIG. 9 and to FIG. 13.

FIG. 14 illustrates a blade set assembly 316 having a stationary blade 334 and a movable blade 352. A biasing element 362 is provided that urges the movable blade 352 against the stationary blade 334. Between the stationary blade 344 and the movable blade 352, a guide unit 366 is provided. The guide unit 366 comprises two parallel guideways 368, 370.

In the guideway 368, 370, rolling elements 378, 380 are arranged. The guideways 368, 370 are formed by a guide recess 384 and a corresponding guide protrusion 386. The guide recess 384 is arranged between two guide bars 388, 390 extending from the stationary blade 334 towards the movable blade 352. The guide protrusion 386 extends from the movable blade 352 towards the stationary blade 334.

Further, a decoupling unit 400 is arranged between the biasing element 362 and the movable blade 352. The decoupling unit 400 defines two guideways 402, 404 that accommodate rolling elements 408, 410 therein.

The biasing element 362 engages a guide plate 406 that faces the bottom side of the movable blade 352. Both the movable blade 352 and the guide plate 406 contact the rolling elements 408, 410. The two guideways 402, 404 are formed between a guide recess 412 that is arranged as a groove or depression in the guide plate 406, and a guide protrusion 414 extending from the movable blade 452 and into the guide recess 412.

The width extension (X-extension) of the guide recess 412 and the guide protrusion formed 414 are adapted to one another so as to define the slot-shaped guideways 402, 404 for the rolling elements 408, 410 therebetween.

FIG. 15 illustrates a blade set assembly 416 having a stationary blade 434 and a movable blade 452. A biasing element 462 is provided that urges the movable blade 452 against the stationary blade 434. Between the stationary blade 434 and the movable blade 452, a guide unit 466 is provided. The guide unit 466 comprises two parallel guideways 468, 470. In the guideway 468, 470, rolling elements 478, 480 are arranged.

The guideways 468, 470 are formed by a guide recess 484 and a corresponding guide protrusion 486. The guide recess 484 is arranged as a depression in the stationary blade 434 at the side thereof that is facing the movable blade 452. The guide protrusion 486 extends from the movable blade 452 towards the stationary blade 434 and into the guide recess 484.

It is worth mentioning in this context that at least in some embodiments the guide units described herein are arranged in the frontal section of the respective blades, i.e. closer to the frontal ends, where the teeth are formed, then to the rear ends of the blades.

Preferably, the guide unit is, in the longitudinal direction (X-direction), arranged in the region where the biasing element contacts the movable blade to urge the same against the stationary blade. Hence, the force applied by the biasing element can be properly accommodated and does not cause potentially disturbing forces and/moments that are not aligned with the vertical direction (Z-direction). Further, the closer the guide unit is arranged to the tips of the teeth, the better the tip-to-tip distance may be defined and maintained during operation.

By way of example, the guide unit may comprise two guideways that are spaced away from one another. In one embodiment, the guide unit is arranged in the longitudinal direction (X-direction) in such a way that the contact point where the biasing force applied by the biasing element acts on the movable blade is, in the longitudinal direction, between the two guideways. Hence, the biasing force does not generate an interfering torque, bending moment, etc.

Further, in exemplary embodiments as described herein, the guide recess is formed at the stationary blade, while the guide protrusion is formed at the movable blade. This is not to be understood to be limiting. Rather, alternative embodiments are conceivable, wherein the guide recess is arranged at the movable blade and wherein the guide protrusion is arranged at the stationary blade.

Further, it is to be noted that any of the stationary blade and the movable blade may be arranged as one of a one-piece part, a composite part, and or an assembled unit. Consequently, components and elements of the guide unit and, if any, the decoupling unit, may be integrally shaped with the respective blade, or may be provided as separate parts that are attached or affixed to a main body of the respective blade.

Further, generally, the rolling elements may be arranged as bearing balls. However, also other arrangements of rolling elements may be envisaged, for instance needles, pins, cones, etc.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A blade set assembly for a hair cutting appliance, the blade set assembly comprising:

a stationary blade having stationary blade teeth forming a stationary blade leading edge, a movable blade having movable blade teeth forming a movable blade leading edge, wherein the movable blade and the stationary blade are arranged one on top of the other and operable to be moved with respect to each other in a lateral direction, and a guide unit formed between the movable blade and the stationary blade, the movable blade and the stationary blade engaging each other at the guide unit, wherein the guide unit is arranged to set a longitudinal distance between the stationary blade leading edge and the movable blade leading edge and to define a movement path for the relative movement between the stationary blade and the movable blade, and wherein the guide unit comprises at least two, longitudinally spaced, laterally extending guideways, each defined between a stationary blade guide surface of the stationary blade and a movable blade guide surface of the movable blade, wherein the stationary blade guide surface and the movable blade guide surface overlap each other, wherein the stationary blade guide surface and the movable blade guide surface are formed at a guide protrusion and a guide recess, respectively, and wherein the guide protrusion and the guide recess are arranged at the movable blade and the stationary blade, respectively, wherein rolling elements are arranged at the at least two guideways, wherein the rolling elements are confined between the stationary blade guide surface and the movable blade guide surface, wherein the stationary blade guide surface and the movable blade guide surface of each guideway have a height extension that is greater than a radius of the rolling elements, such that the stationary blade guide surface and the movable blade guide surface of each guideway overlap each other in a vertical direction, and wherein the stationary blade guide surfaces and the movable blade guide surfaces of the at least two guideways therebetween provide for a defined positive-fit coupling in a longitudinal direction between the stationary blade and the movable blade such that the guide unit provides for the set longitudinal distance for any force applied in the longitudinal direction.

2. The blade set assembly as claimed in claim 1, wherein the guide protrusion and the guide recess engage each other, wherein the guide protrusion and the guide recess define a first guideway and a second guideway of the at least two guideways.

3. The blade set assembly as claimed in claim 2, wherein the guide recess is arranged as a depression in one of the stationary blade and the movable blade having a longitudinal extension that is greater than a longitudinal extension of the guide protrusion.

4. The blade set assembly as claimed in claim 2, wherein the guide recess is formed between two guide bars protruding from one of the stationary blade and the movable blade towards the other of the movable blade and the stationary blade.

5. The blade set assembly as claimed in claim 1, wherein the at least two guideways are defined by four guide surfaces among which two of the four guide surfaces are arranged at the stationary blade and the other two of the four guide surfaces are arranged at the movable blade, such that the rolling elements arranged in the guideways are contacted by respective guide surfaces.

6. The blade set assembly as claimed in claim 1, further comprising a decoupling unit that decouples a movement of the movable blade from a biasing element that urges the movable blade against the stationary blade.

7. The blade set assembly as claimed in claim 6, wherein the decoupling unit comprises a guide plate arranged between the biasing element and the movable blade, wherein the biasing element pushes the guide plate against the movable blade.

8. The blade set assembly as claimed in claim 6, wherein the decoupling unit comprises at least one guideway for the rolling elements.

9. The blade set assembly as claimed in claim 6, wherein the decoupling unit is arranged to transmit only a vertical push force applied by the biasing element, and decouples longitudinal forces and lateral forces.

10. The blade set assembly as claimed in claim 1, wherein the rolling elements comprise bearing balls.

11. A blade set assembly for a hair cutting appliance, the blade set assembly comprising:

a stationary blade having stationary blade teeth forming a stationary blade leading edge, a movable blade having movable blade teeth forming a movable blade leading edge, wherein the movable blade and the stationary blade are arranged one on top of the other and operable to be moved with respect to each other in a lateral direction, a guide unit formed between the movable blade and the stationary blade, the movable blade and the stationary blade engaging each other at the guide unit, and a decoupling unit that decouples a movement of the movable blade from a biasing element that urges the movable blade against the stationary blade, wherein the guide unit is arranged to set a longitudinal distance between the stationary blade leading edge and the movable blade leading edge and to define a movement path for the relative movement between the stationary blade and the movable blade, and wherein the guide unit comprises at least two, longitudinally spaced, laterally extending guideways, each defined between a stationary blade guide surface of the stationary blade and a movable blade guide surface of the movable blade, wherein the stationary blade guide surface and the movable blade guide surface overlap each other, wherein rolling elements are arranged at the at least two guideways, wherein the rolling elements are confined between the stationary blade guide surface and the movable blade guide surface, wherein the stationary blade guide surface and the movable blade guide surface of each guideway have a height extension that is greater than a radius of the rolling elements, such that the stationary blade guide surface and the movable blade guide surface of each guideway overlap each other in a vertical direction, and wherein the stationary blade guide surfaces and the movable blade guide surfaces of the at least two guideways therebetween provide for a defined positive-fit coupling in a longitudinal direction between the stationary blade and the movable blade such that the guide unit provides for the set longitudinal distance for any force applied in the longitudinal direction.

12. The blade set assembly as claimed in claim 11, wherein each of the stationary blade guide surfaces and each of the movable blade guide surfaces are formed at a guide protrusion and a guide recess, respectively, and wherein the guide protrusion and the guide recess are arranged at the movable blade and the stationary blade, respectively.

13. The blade set assembly as claimed in claim 12, wherein the guide protrusion and the guide recess engage each other, wherein the guide protrusion and the guide recess define a first guideway and a second guideway of the at least two guideways.

14. The blade set assembly as claimed in claim 13, wherein the guide recess is arranged as a depression in one of the stationary blade and the movable blade having a longitudinal extension that is greater than a longitudinal extension of the guide protrusion.

15. The blade set assembly as claimed in claim 13, wherein the guide recess is formed between two guide bars protruding from one of the stationary blade and the movable blade towards the other of the movable blade and the stationary blade.

16. The blade set assembly as claimed in claim 11, wherein the at least two guideways are defined by four guide surfaces among which two of the four guide surfaces are arranged at the stationary blade and the other two of the four guide surfaces are arranged at the movable blade, such that the rolling elements arranged in the guideways are contacted by respective guide surfaces.

17. The blade set assembly as claimed in claim 11, wherein the decoupling unit comprises a guide plate arranged between the biasing element and the movable blade, wherein the biasing element pushes the guide plate against the movable blade.

18. The blade set assembly as claimed in claim 11, wherein the decoupling unit comprises at least one guideway for the rolling elements.

19. The blade set assembly as claimed in claim 11, wherein the decoupling unit is arranged to transmit only a vertical push force applied by the biasing element, and decouples longitudinal forces and lateral forces.

20. The blade set assembly as claimed in claim 11, wherein the rolling elements comprise bearing balls.

* * * * *